US007234181B1

(12) United States Patent
Griggs

(10) Patent No.: US 7,234,181 B1
(45) Date of Patent: Jun. 26, 2007

(54) INCLINE SLEEPER FOR AN INFANT

(76) Inventor: Christine Griggs, 5372 Village La., Fort Worth, TX (US) 76119

( * ) Notice: Subject to any disclaimer, the term of this patent is extended or adjusted under 35 U.S.C. 154(b) by 0 days.

(21) Appl. No.: 11/266,525

(22) Filed: Nov. 3, 2005

Related U.S. Application Data

(63) Continuation-in-part of application No. 11/068,312, filed on Feb. 24, 2005, now abandoned.

(51) Int. Cl.
*A47D 7/00* (2006.01)

(52) U.S. Cl. ..... 5/655; 5/632

(58) Field of Classification Search ..... 5/655, 5/632; 297/452.31, 452.32; 128/871
See application file for complete search history.

(56) References Cited

U.S. PATENT DOCUMENTS

D259,458 S 6/1981 Fuller et al.
4,359,045 A * 11/1982 Cozzi ..... 601/5
4,388,713 A * 6/1983 Tatsuguchi ..... 369/47.39
4,907,306 A * 3/1990 Nakaji ..... 5/632
5,127,120 A * 7/1992 Mason ..... 5/655
5,331,699 A 7/1994 Patton et al.
5,450,640 A 9/1995 Patton et al.
5,551,109 A 9/1996 Tingley et al.
5,566,413 A * 10/1996 Webb et al. ..... 5/655
5,800,368 A * 9/1998 Klingemann et al. ..... 602/1
6,549,410 B1 4/2003 Koessler

* cited by examiner

*Primary Examiner*—Michael Trettel
(74) *Attorney, Agent, or Firm*—Eric Karich

(57) ABSTRACT

An incline sleeper for an infant has a base and a resilient insert adapted to fit in the base within a peripheral lip. The resilient insert and the base cooperate to support a top surface of the resilient insert at an angle with respect to a lower surface of the base. The top surface of the resilient insert includes an infant-receiving depression that is adapted to receive and support the infant in a supine and angled position.

14 Claims, 2 Drawing Sheets

INCLINE SLEEPER FOR AN INFANT

CROSS-REFERENCE TO RELATED APPLICATIONS

This application for a utility patent is a continuation-in-part of a previously filed utility patent, now abandoned, having the application Ser. No. 11/068,312, filed Feb. 24, 2005.

BACKGROUND OF THE INVENTION

1. Field of the Invention

This invention relates generally to sleepers for infants, and more particularly to an incline sleeper that enables an infant to sleep in a supine, inclined position.

2. Description of Related Art

The following art defines the present state of this field:

Webb et al., U.S. Pat. No. 5,566,413, teaches an infant restraint that includes a planar foam padding that is adapted to be mounted in a rectangular plastic bin. The planar foam padding includes a depression shaped to receive an infant. The Webb reference does not teach a device that holds the infant at an incline, and does not teach a plurality of padded inserts that have infant-receiving depressions that vary in size, to accommodate the infant as he grows.

Other references, including Fuller et al., U.S. Pat. No. D259,458, and Tingley et al., U.S. Pat. No. 5,551,109, teach a support pad or pillow that includes an upper surface that has a slight incline for supporting an infant's head above his or her feet.

The above-described references are hereby incorporated by reference in full.

The prior art teaches a pillow, alone, that has a top surface that is slightly inclined. The prior art also teaches a plastic support tray for holding a flat pillow. However, the prior art does not teach an incline sleeper that includes a plastic support tray and a pillow that together support an infant in a supine position on a top surface that is inclined about 15 degrees. The prior art also does not teach an incline sleeper that includes a plurality of resilient inserts that enable the incline sleeper to be adapted to the infant as the infant grows.

The present invention fulfills these needs and provides further related advantages as described in the following summary.

SUMMARY OF THE INVENTION

The present invention teaches certain benefits in construction and use which give rise to the objectives described below.

The present invention provides an incline sleeper for an infant. The incline sleeper includes a base having a lower surface, an upper surface, and a peripheral lip extending upwardly from the upper surface. The incline sleeper further includes a resilient insert adapted to fit on the upper surface and within the peripheral lip, the resilient insert having a top surface. The resilient insert and the base cooperate to support the top surface at an angle with respect to the lower surface of the base. The top surface of the resilient insert includes an infant-receiving depression that is adapted to receive and support the infant in a supine and angled position.

A primary objective of the present invention is to provide an incline sleeper having advantages not taught by the prior art.

Another objective is to provide an incline sleeper that supports an infant in a supine and angled position, with the incline sleeper having a top surface that is inclined about 15 degrees.

A further objective is to provide an incline sleeper that includes a plurality of resilient inserts that enable the incline sleeper to be adapted to the infant as the infant grows.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
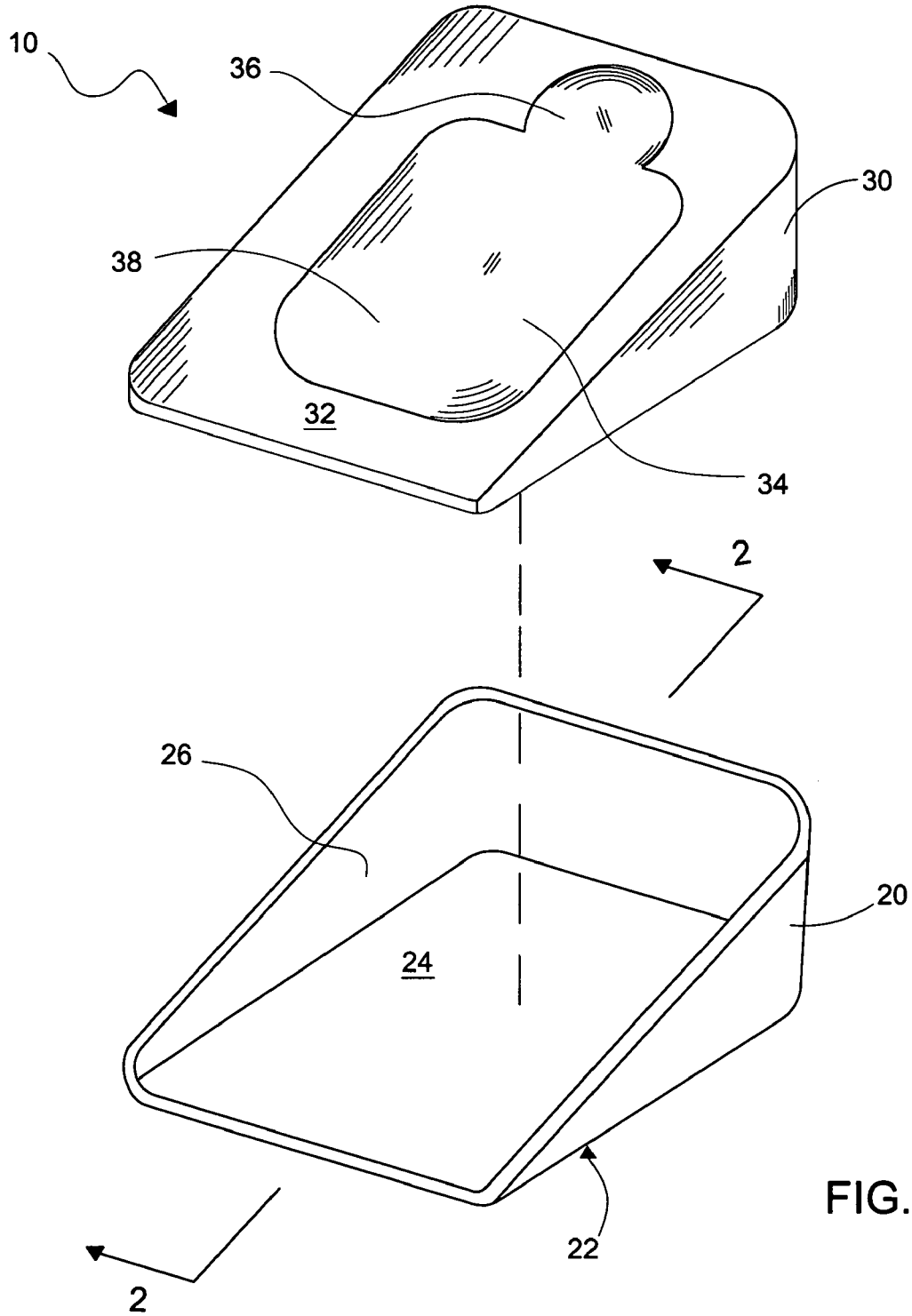
FIG. 1 is an exploded perspective view of an incline sleeper according to a preferred embodiment of the present invention.

The above-described drawing figures illustrate the invention, an incline sleeper 10 for an infant. The incline sleeper 10 includes a base 20 and a resilient insert 30 that together support an infant in a supine position on a top surface 32 that is inclined about 15 degrees. The incline sleeper 10 preferably includes a plurality of resilient inserts 40 that enable the incline sleeper 10 to be adapted to the infant as the infant grows.

As shown in FIG. 1, the base 20 is adapted to receive and support the resilient insert 30. The base 20 has a lower surface 22, an upper surface 24, and a peripheral lip 26 extending upwardly from the upper surface 24. The resilient insert 30 adapted to fit on the upper surface 24 of the base 20 and within the peripheral lip 26 such that the top surface 32 of the resilient insert 30 is positioned for receiving the infant.

As shown in FIG. 1, the resilient insert 30 or pillow is adapted to fit within the base 20. The resilient insert 30 has a top surface 32 that functions to support the infant in a supine position at an angle A of about 15 degrees, and is most preferably constructed of foam rubber, or other suitable resilient material.

Figure 2:
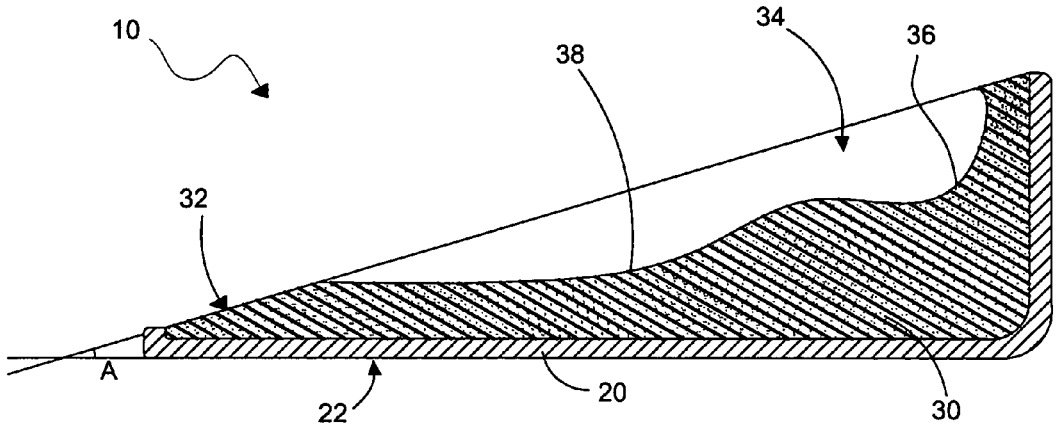
FIG. 2 is a sectional view thereof taken along line 2-2 in FIG. 1.

As shown in FIG. 2, the resilient insert 30 and the base 20 cooperate to support the top surface 32 at an angle A with respect to the lower surface 22 of the base 20, preferably at an angle A of between 10 and 20 degrees, and most preferably at an angle A of about 15 degrees. For purposes of this application, the term "about" shall include ±2 degrees, and shall also include equivalent shapes and curves that function to support the infant as described herein.

As shown in FIGS. 1 and 2, the top surface 32 of the resilient insert 30 includes an infant-receiving depression 34 that is adapted to receive and support the infant on the resilient insert 30. The infant-receiving depression 34 preferably includes a head receiving portion 36 adapted to receive and support the head of the infant, and a body receiving portion 38 that is adapted to receive and support the body of the infant. The resilient insert 30 may also be covered by a soft fabric exterior (not shown), which may be adapted to be removed for cleaning.

Figure 3:
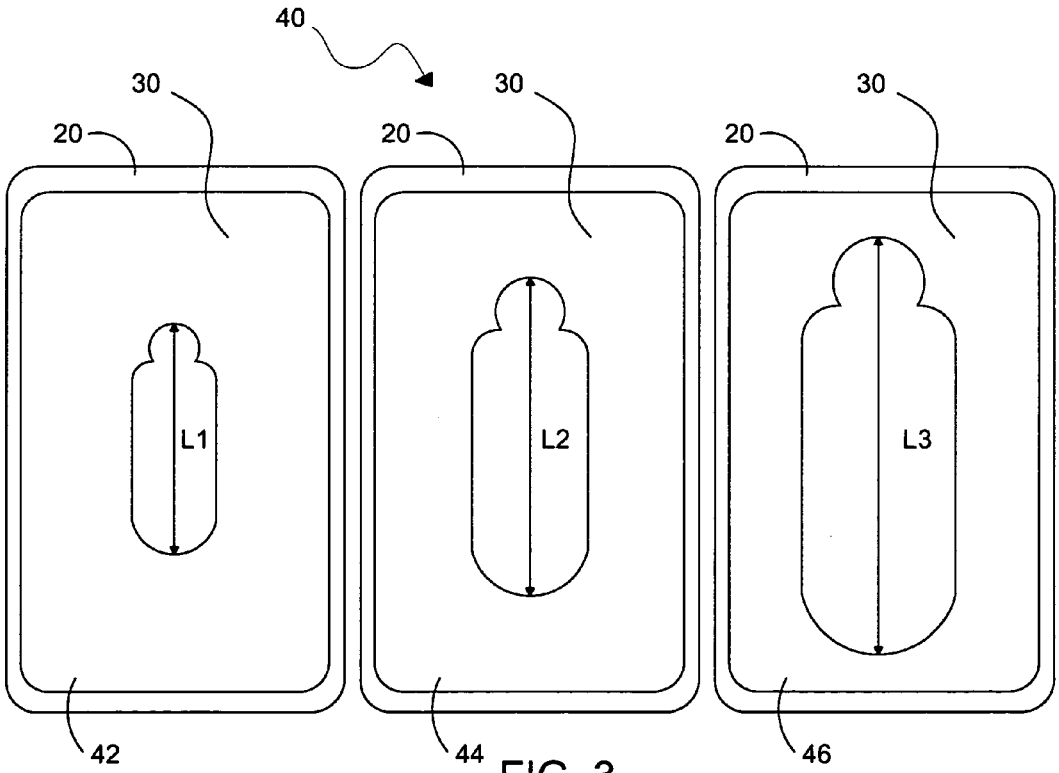
FIG. 3 is a top plan view of a plurality of resilient inserts, illustrating infant-receiving depressions of different length.

As shown in FIG. 3, the incline sleeper 10 preferably includes a plurality of resilient inserts 40, each of the resilient inserts 40 having a different size of the infant-receiving depression 34. A first one 42 of the plurality of resilient inserts 40 has a first length L1, a second one 44 of the plurality of resilient insert 40 has a second length L2, and third one 46 of the plurality of resilient inserts 40 has a third length L3. The first length L1 is approximately the length of an infant that is 6 months old, the second length L2 is larger than the first length L1, and the third length L3 is preferably larger than the second length L2. Obviously, those skilled in the art can devise different arrangements of inserts, each having different lengths, and any combination thereof should be considered within the scope of the claimed invention.

As shown in FIGS. 1-3, the incline sleeper 10 enables a novel method for supporting an infant to prevent SIDS. The method includes first providing the incline sleeper 10 described above. The first one 42 of the plurality of resilient inserts 40 is inserted, whose infant-receiving depression 34 is sized to fit the infant. The present method teaches the first use of the incline sleeper 10 at about 6 months of age, so the resilient insert 30 is preferably selected whose infant-receiving depression 34 is sized to receive a 6 month old infant.

As shown in FIG. 1, the first one 42 of the plurality of resilient inserts 40 is positioned on the base 20. The infant is then positioned on the infant-receiving depression 34 of the first one 42 of the plurality of resilient inserts 40 such that the infant is held securely in place on the incline sleeper.

After time has passed and the infant has grown, the second one 44 of the plurality of resilient inserts 40 is selected whose infant-receiving depression 34 is sized to fit the infant now that the infant is larger. This process is continued until the infant has outgrown the incline sleeper 10 and is no longer in danger of SIDS.

Certain terminology is used in the preceding description for convenience only, and is not limiting. For example, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An incline sleeper for an infant, the incline sleeper comprising:

a base having a lower surface, an upper surface, and a peripheral lip extending upwardly from the upper surface;

a resilient insert adapted to fit on the upper surface and within the peripheral lip, the resilient insert having a top surface, the resilient insert and the base cooperating to support the top surface at an angle with respect to the lower surface of the base, wherein the angle is between 10 and 20 degrees; and an infant-receiving depression in the top surface of the resilient insert, the infant-receiving depression being adapted to receive and support the infant on the resilient insert.

2. The incline sleeper of claim 1, wherein the angle is about 15 degrees.

3. The incline sleeper of claim 1, wherein the infant-receiving depression includes a head receiving portion and a body receiving portion.

4. The incline sleeper of claim 1, wherein the incline sleeper includes a plurality of resilient inserts, each of the resilient inserts having a different size of the infant-receiving depression.

5. The incline sleeper of claim 4, wherein a first one of the plurality of resilient inserts has a first length, and wherein a second one of the plurality of resilient inserts has a second length.

6. The incline sleeper of claim 5, wherein the first length is approximately the length of an infant that is 6 months old, and wherein the second length is larger than the first length.

7. The incline sleeper of claim 1, wherein the infant is supported in a supine position on the resilient insert, with his or her head above his or her feet.

8. An incline sleeper for an infant, the incline sleeper comprising:

a base having a lower surface, an upper surface, and a peripheral lip extending upwardly from the upper surface;

a plurality of resilient inserts, each of the plurality of resilient inserts being adapted to fit on the upper surface and within the peripheral lip;

each of the plurality of resilient inserts being adapted to cooperate with the base to support a top surface at an angle with respect to the lower surface of the base; and each of the plurality of resilient inserts having an infant-receiving depression in the top surface of the resilient insert, the infant-receiving depression being adapted to receive and support the infant on the resilient insert, each of the infant-receiving depressions of the plurality of resilient inserts having a different length.

9. The incline sleeper of claim 8, wherein the angle is between 10 and 20 angles.

10. The incline sleeper of claim 8, wherein the angle is about 15 degrees.

11. The incline sleeper of claim 8, wherein the infant-receiving depression includes a head receiving portion and a body receiving portion.

12. The incline sleeper of claim 8, wherein the infant is supported in a supine position on the resilient insert, with his or her head above his or her feet.

13. A method for supporting an infant, the method comprising the steps of:

providing an incline sleeper for an infant, the incline sleeper comprising:

a base having an upper surface;

a plurality of resilient inserts, each of the plurality of resilient inserts having a top surface and being adapted to fit on the upper surface of the base; and an infant-receiving depression in the top surface of each of the plurality of resilient inserts, each of the infant-receiving depressions adapted to receive and support the infant, each of the infant-receiving depressions having a different length;

selecting a first one of the plurality of resilient inserts whose infant-receiving depression is sized to fit the infant;

positioning the first one of the plurality of resilient inserts on the base;

positioning the infant on the infant-receiving depression of the first one of the plurality of resilient insert such that the infant is held securely in place on the incline sleeper;

selecting, after time has passed and the infant has grown, a second one of the plurality of resilient inserts whose infant-receiving depression is sized to fit the infant now that the infant is larger;

positioning the second one of the plurality of resilient inserts on the base;

positioning the infant on the infant-receiving depression of the second one of the plurality of resilient insert such that the infant is held securely in place on the incline sleeper.

14. The method of claim 13 wherein the infant is supported in a supine position on the resilient insert, with his or her head above his or her feet.

* * * * *